US005689924A

United States Patent [19]

Mason

[11] Patent Number: 5,689,924

[45] Date of Patent: Nov. 25, 1997

[54] CONSTRUCTION OF MODULAR OFFICE PANEL SYSTEMS

[75] Inventor: Timothy R. Mason, Muscatine, Iowa

[73] Assignee: Hon Industries, Inc., Muscatine, Iowa

[21] Appl. No.: 729,833

[22] Filed: Oct. 7, 1996

[51] Int. Cl.[6] ..... E04H 3/00

[52] U.S. Cl. ..... 52/239; 52/222; 52/273; 160/351

[58] Field of Search ..... 52/656.1, 656.2, 52/239, 716.6, 716.7, 238.1, 222, 273; 160/135, 351, 398, 404

[56] References Cited

U.S. PATENT DOCUMENTS

| | | | |
|---|---|---|---|
| 3,766,692 | 10/1973 | Stark et al. | 160/135 X |
| 3,871,153 | 3/1975 | Birum, Jr. | 52/239 X |
| 4,144,924 | 3/1979 | Vanden Hoek | 160/135 X |
| 4,188,764 | 2/1980 | Gode | 52/656.1 X |
| 4,213,493 | 7/1980 | Haworth | 160/351 |
| 4,891,922 | 1/1990 | Hozer et al. | 52/239 |
| 5,025,603 | 6/1991 | Johnson | 52/239 X |
| 5,070,666 | 12/1991 | Looman | 52/239 |
| 5,238,515 | 8/1993 | Insalaco et al. | 160/135 X |
| 5,339,576 | 8/1994 | Fussler | 52/239 X |
| 5,377,466 | 1/1995 | Insalaco et al. | 160/15 X |

*Primary Examiner*—Carl D. Friedman
*Assistant Examiner*—Creighton Smith
*Attorney, Agent, or Firm*—Jones, Day, Reavis & Pogue

[57] ABSTRACT

A modular office panel system comprises a central core surrounded by a rigid frame. A pair of generally rigid panel members are disposed on opposite sides of the core. A channel member has a central portion disposed between the frame and core with right angle bent sides extending around opposite sides of the frame. The channel member sides terminate in reversely bent portions defining flanges for engaging the rigid panel members. The reversely bent portions also define resilient edge portions in engagement with the sides of the frame. A fabric material covers the panel members and is retained on the panel by insertion of marginal edges of the fabric between the sides of the frame and the resilient edge portions of the channel member.

9 Claims, 3 Drawing Sheets

CONSTRUCTION OF MODULAR OFFICE PANEL SYSTEMS

BACKGROUND OF THE INVENTION

1. Field of the Invention

The present invention relates generally to the construction of modular office panel systems and, more particularly, to a method and apparatus for securing decorative fabric coverings to a panel frame in an inexpensive and effective manner.

2. Description of the Prior Art

Increasingly in office environments, it is common to find work space partitions in the form of modular wall panels. These panels are typically not designed to run from floor to ceiling but rather are free standing and are assembled as modules to enclose or partially enclose a work space. Forms of wall panel systems are known having wall hung desk surfaces, cabinets, shelves and the like. These systems are usually easy to set up with a minimum of tools required for assembly. They may also have wire management capability such that a complete work space enclosure may be constructed with electrical office equipment suitable for a variety of tasks. These systems may also be disassembled or reconfigured with only minimal disruption of the office environment. Thus, they have gained wide acceptance in recent times in the construction of modern office space, particularly where there is a need to have flexibility in office accommodations.

Many forms of wall panel systems are known having various constructions and different aesthetic appearances. In one popular form, panels are constructed with steel frames surrounding cores of some type of lightweight material. The core may be fiberboard or fiberglass having sound deadening capabilities. Often, these panels are covered with pieces of fabric supplied in colors which are meant to access the particular decor of the office. Fabric can be attached to panel assemblies in a variety of ways. One such attachment method is disclosed in U.S. Pat. No. 5,086,606, issued to Finses. By the method disclosed in that patent, a steel panel frame is specially formed with a U-shaped channel opening outwardly from the frame, and each of the edges of the channels are provided with an outwardly facing grooved channel extending along its length for receiving the edges of a sheet of fabric. The interiors of the grooves channels contain an undercut portion adapted to secure the edges of the fabric and welting. Although this panel construction performs satisfactorily in securely attaching fabric, the steel frame requires several steps in the manufacturing process to provide the grooved channels which retain the edges of the fabric.

Accordingly, it is desirable to provide a panel system having the capability of securely attaching the covering fabric in a simple but effective manner. It is further desirable to provide such a system which is highly cost effective to manufacture. Still further, it is desirable to provide such a system having a highly aesthetically pleasing finished appearance.

SUMMARY OF THE INVENTION

The present invention improves over the prior art by providing a modular office panel system comprising a central core surrounded by a rigid frame. A pair of generally rigid panel members are disposed on opposite sides of the core. A channel member has a central portion disposed between the frame and core with right angle bent sides extending around opposite sides of the frame. The channel member sides terminate in reversely bent portions defining flanges for engaging the rigid panel members. The reversely bent portions also define resilient edge portions in engagement with the sides of the frame. A fabric material covers the panel members and is retained on the panel by insertion of marginal edges of the fabric between the sides of the frame and the resilient edge portions of the channel member.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENT

Figure 1:
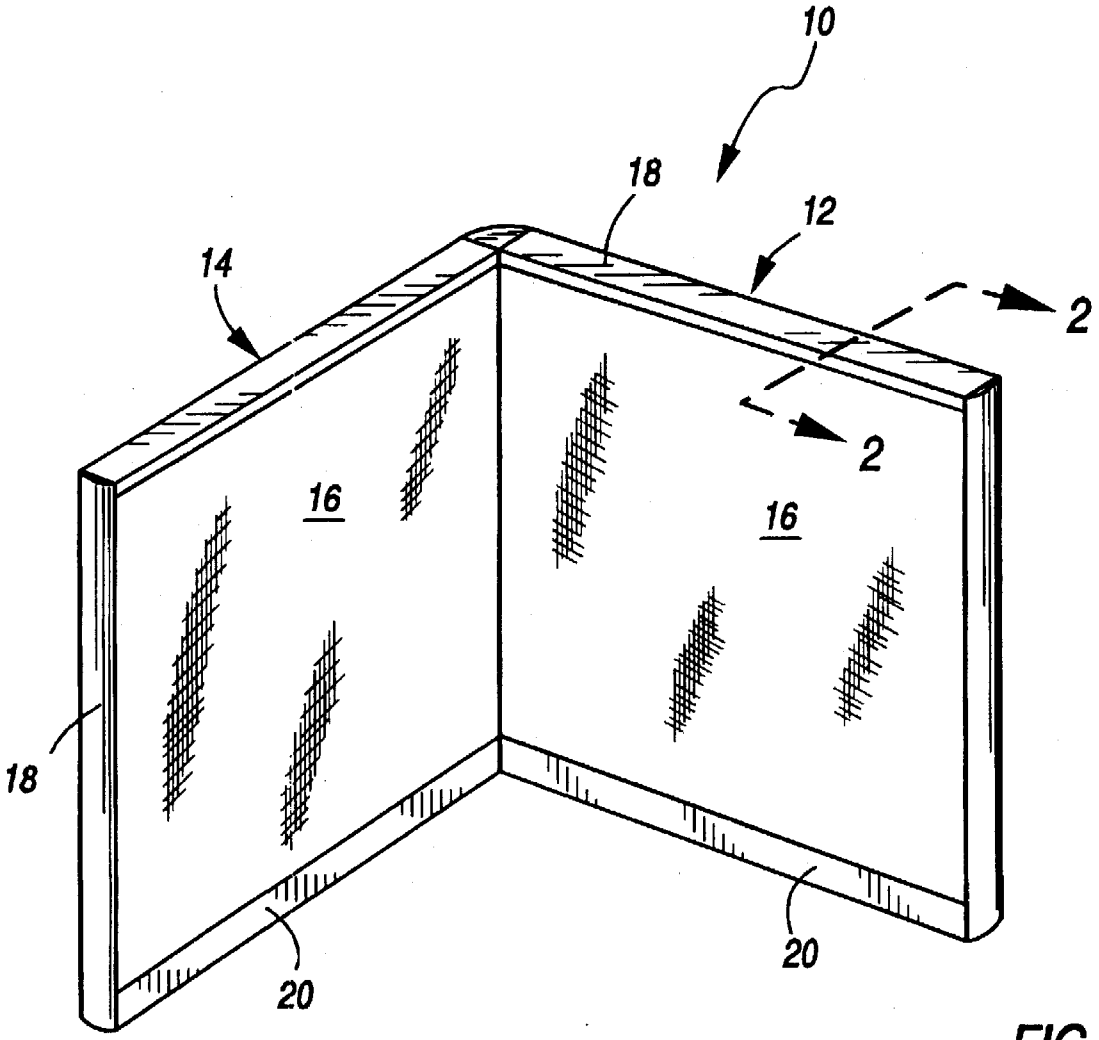
FIG. 1 is a perspective view of a typical modular office panel system.

Referring now to the drawings, and initially to FIG. 1, a modular office panel system is designated generally by the reference numeral 10. The panel system 10, as shown, includes two individual panel assemblies 12 and 14 connected at an angle to define a corner. The corner may in a manner well-known in the art be provided with connector means (not shown) to securely fasten the panels 12 and 14 together. The system 10 is typical of panel construction in that the panels 12 and 14 are covered with a decorative fabric 16. Suitable caps 18 are provided to trim the free edges of the panels 12 and 14. Also, as known, the panels 12 and 14 may have removable covers 20 along the bottoms of the panel 12 and 14 to provide access to suitable wire management means (not shown).

Figure 2:
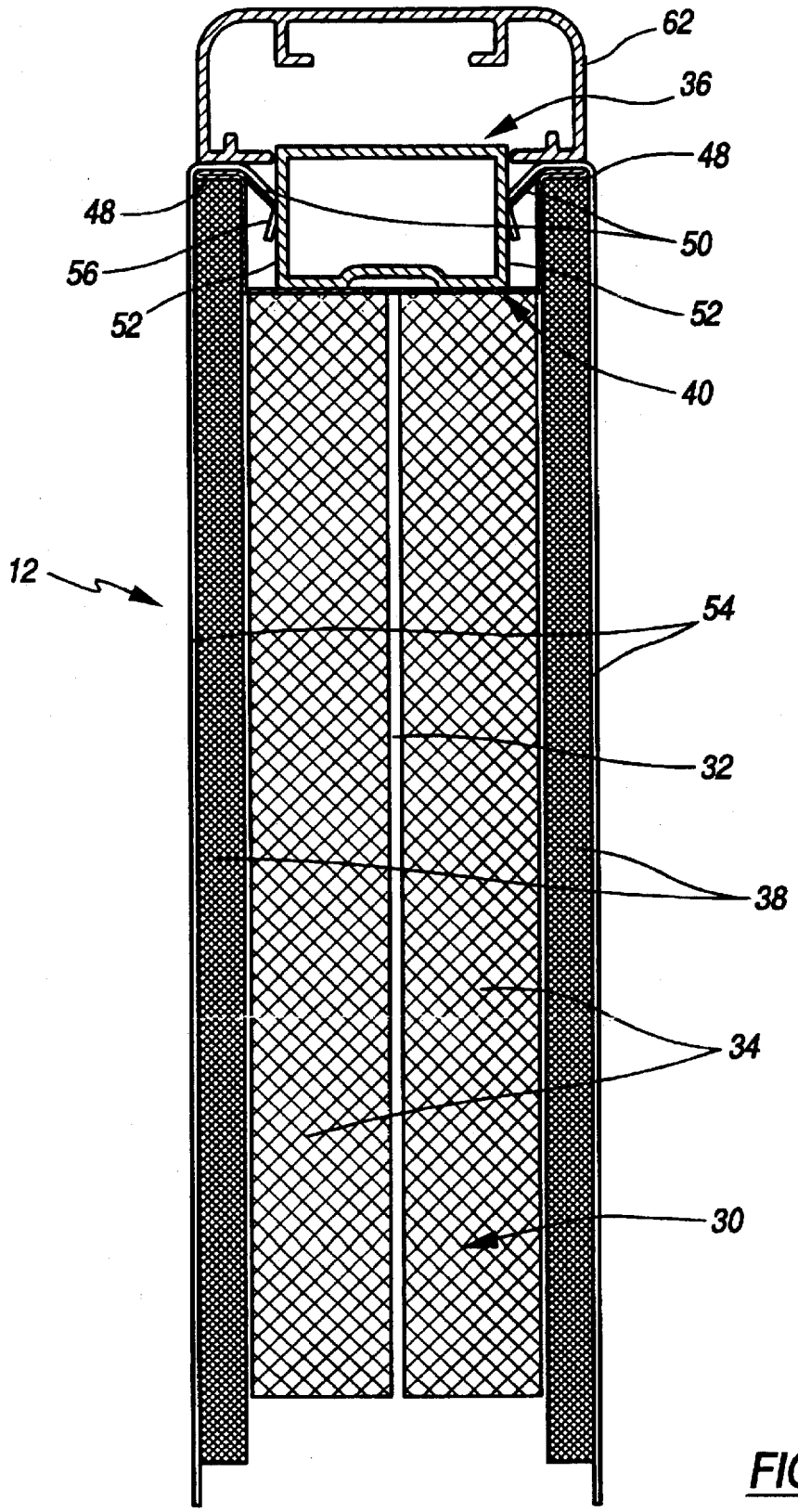
FIG. 2 is a cross-sectional view taken substantially along the line 2—2 of FIG. 1 showing a panel construction in accordance with the present invention.

Turning now to FIG. 2, the details of a panel member 12 constructed in accordance with the principles of the invention is illustrated in cross-section. The panel member 12 has a core, generally designated by the reference numeral 30 comprising a central rigid chipboard septum 32 disposed between layers of low density glass bart 34. The glass batt serves as a sound deadening material. The core 30 is positioned within a rigid frame 36 which is preferably constructed of roll formed steel. Covering the sides of the core are panel members 38 which in a preferred form are constructed of 3.0 to 5.0 lb. rigid fiberglass.

Figure 3:
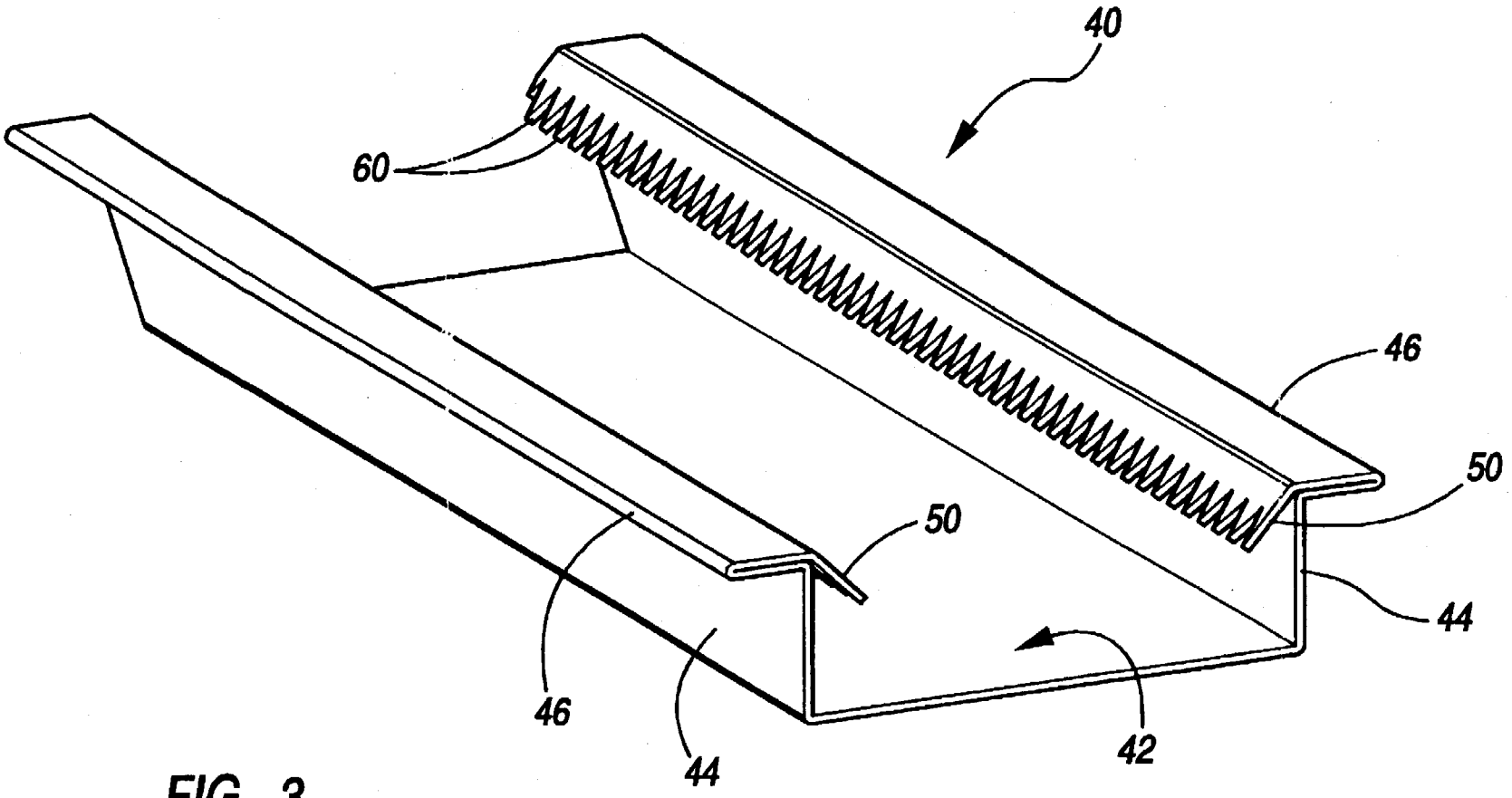
FIG. 3 is a perspective view of a fabric attachment channel member illustrated in FIG. 2 and constructed in accordance with the invention.

In accordance with the invention and as best seen in FIGS. 2 and 3, a channel member 40 is provided and positioned between the frame 36 and core 30. The channel member 40 has a central web portion 42 with two right angle bent side portions 44. The side portions 44 terminate in reversely bent right angle flange portions 46 which, as best seen in FIG. 2, engage edges 48 of the panel members 38. The reverse bend also forms marginal edge portions 50 which are preferably bent at an angle to project generally inwardly toward the core 30. The dimension and configuration of the channel member 40 is such that the edge portions 50 are resiliently biased against opposed sides 52 of the frame 36.

As is typical of modular office panels, the panel members 38 are overcovered with a decorative fabric material 54. In order to install the fabric 54, marginal edges 56 of a fabric sheet are forced, using a bladed tool or the like, between the frame 36 and the resilient edge portion 50 of the channels 40. The resilience of the edge portions 50 frictionally retains the fabric 54 in place. Also, as best seen in FIG. 3, the edge portions 50 are preferably provided with teeth 60 to further grip the fabric edges 56. The attachment method also provides the benefit of not having to trim the excess material from the fabric edges 56 after attachment. A suitable top cap 62 may be provided to lend a finished appearance to the edge of the panel 12.

It can now be appreciated that modular office panel 12 constructed according to the present invention can be readily manufactured by well-known techniques. The channel member 40, for example, can be a simple stamped and formed metal member, yet it is highly effective in retaining the fabric 54 stretched over the panel members 38. The channel member 50 also serves the dual function of supporting the panel members 38 by virtue of its flange portions 46. With a simple top cap 62, as shown, the edge of the panel 12 thus has a highly aesthetically pleasing finished appearance.

While the present invention has been described in connection with a preferred embodiment thereof, it will be apparent to those skilled in the art that many changes and modifications may be made without departing from the true spirit and scope of the invention. Accordingly, it is intended by the appended claims to cover all such changes and modifications as come within the spirit and scope of the invention.

What is claimed is:

1. A modular office panel system comprising:

a central core;

a rigid frame surrounding said core;

a pair of generally rigid panel members each disposed on opposite sides of said core;

a channel member having a central portion disposed between said frame and said core and having sides extending from said central portion around sides of said frame, said channel member sides terminating in reversely bent portions defining flanges that engages said rigid panel members, said reversely bent portions each defining a resilient edge portion in engagement with a side of said frame;

a decorative outer covering over said panel members;

wherein said covering is retained over said panel members by insertion of marginal edges of said covering between said sides of said frame and said resilient edge portions of said channel member.

2. The system of claim 1 wherein said resilient edge portions are provided with teeth.

3. The system of claim 1 wherein said covering is a decorative fabric.

4. The system of claim 1 wherein said covering is installed over said panel members by forcing marginal edges of said covering between said sides of said frame and said resilient edge portions.

5. The system of claim 4 wherein said marginal edges are forced between said sides of said frame and said edge portions without trimming of said edges.

6. The system of claim 1 wherein said frame and said channel member are covered by a cap.

7. The system of claim 1 wherein said channel member is roll formed from metal.

8. The system of claim 1 wherein said frame is a tubular member having a generally rectangular cross-section.

9. The system of claim 1 wherein said resilient edge portions angle inwardly of said panel toward said central core.

* * * * *